United States Patent [19]

Wellstein

[11] 4,056,144

[45] Nov. 1, 1977

[54] POSITIVE SEAL PITLESS WELL ADAPTER

[76] Inventor: William Wellstein, P.O. Box 430, Fostoria, Ohio 44830

[21] Appl. No.: 747,902

[22] Filed: Dec. 6, 1976

Related U.S. Application Data

[63] Continuation-in-part of Ser. No. 660,396, Feb. 23, 1976.

[51] Int. Cl.[2] ..... E21B 33/03

[52] U.S. Cl. ..... 166/85; 166/88; 277/101; 285/DIG. 19

[58] Field of Search ..... 166/85, 88; 285/211, 285/220, DIG. 19; 277/12, 30, 115, 122, 101

[56] References Cited

U.S. PATENT DOCUMENTS

| | | | |
|---|---|---|---|
| 2,343,235 | 2/1944 | Bashank | 285/DIG. 19 |
| 2,689,611 | 9/1954 | Martinson | 166/88 |
| 2,918,972 | 12/1959 | Tubbs | 166/85 |
| 2,946,385 | 7/1960 | Dicken | 166/85 |
| 2,992,022 | 7/1961 | Risley et al. | 277/101 |
| 3,430,697 | 3/1969 | Wellstein | 166/85 |
| 3,805,891 | 4/1974 | Reinhard et al. | 166/88 |
| 3,812,910 | 5/1974 | Wellistien | 166/88 |
| 3,841,667 | 10/1974 | Sands | 285/220 |
| 3,847,217 | 11/1974 | Kramer et al. | 166/85 |
| 3,958,632 | 5/1976 | Buchman et al. | 166/85 |

*Primary Examiner*—James A. Leppink
*Attorney, Agent, or Firm*—Hugh Adam Kirk

[57] ABSTRACT

This is an improvement in Wellstein's U.S. Pat. No. 3,812,910 issued May 28, 1974 comprising generally: an improved shaped frustoconical seat for the saddle contoured gasket or seat in the washer or nut for better sealing the outside of the well casing with the outside of the nipple that extends through the hole therein for withstanding higher pressures; and/or the employment of a pair of gaskets inside and outside the casing surrounding the nipple and contoured to the interior and exterior walls of the casing, also for insuring better sealing.

The nipple portion of the hanger member has its outer end externally threaded for a nut member which may contain an internal angular frustoconical groove or seat for a saddle contoured gasket which presses the gasket both against the outside cylindrical surface of the nipple outside the outer wall of the casing and against the outer wall of the casing, or the nut may press against a washer which contains such a groove or seat, and may also include a second gasket between the nut and the washer.

64 Claims, 14 Drawing Figures

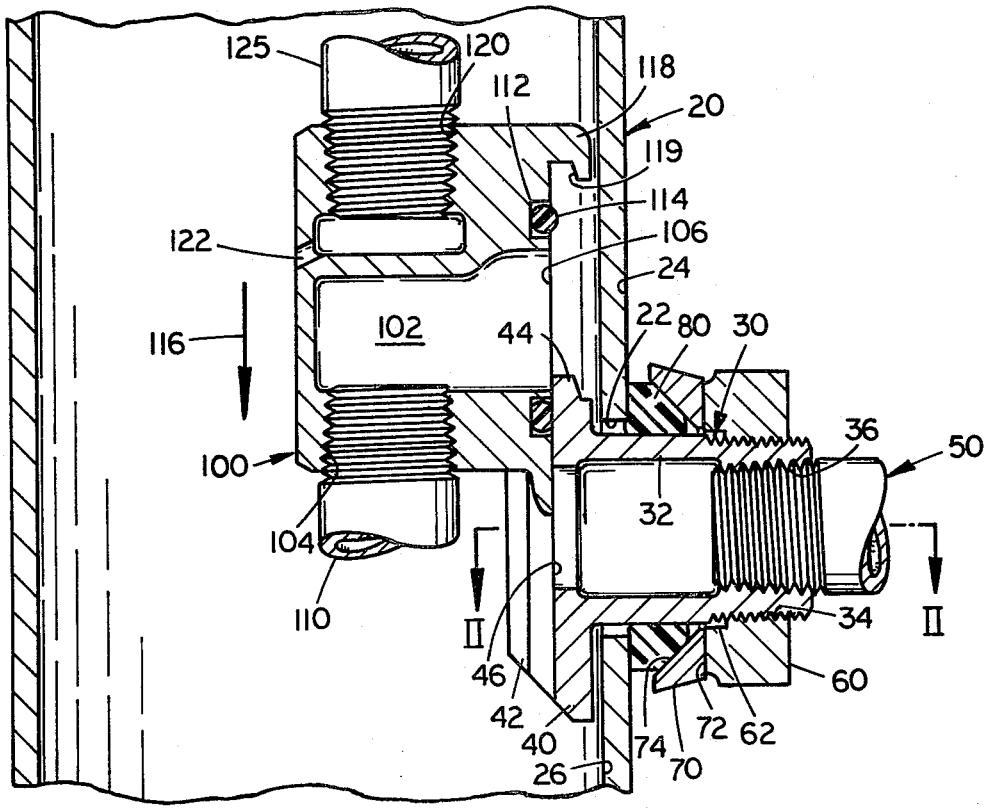
FIG. I
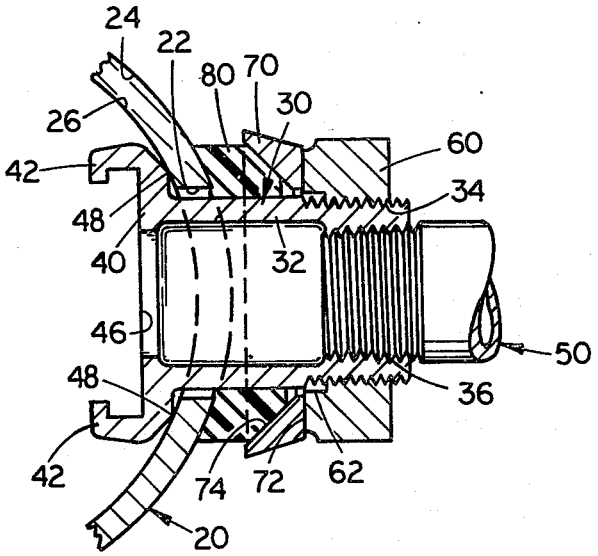
FIG. II

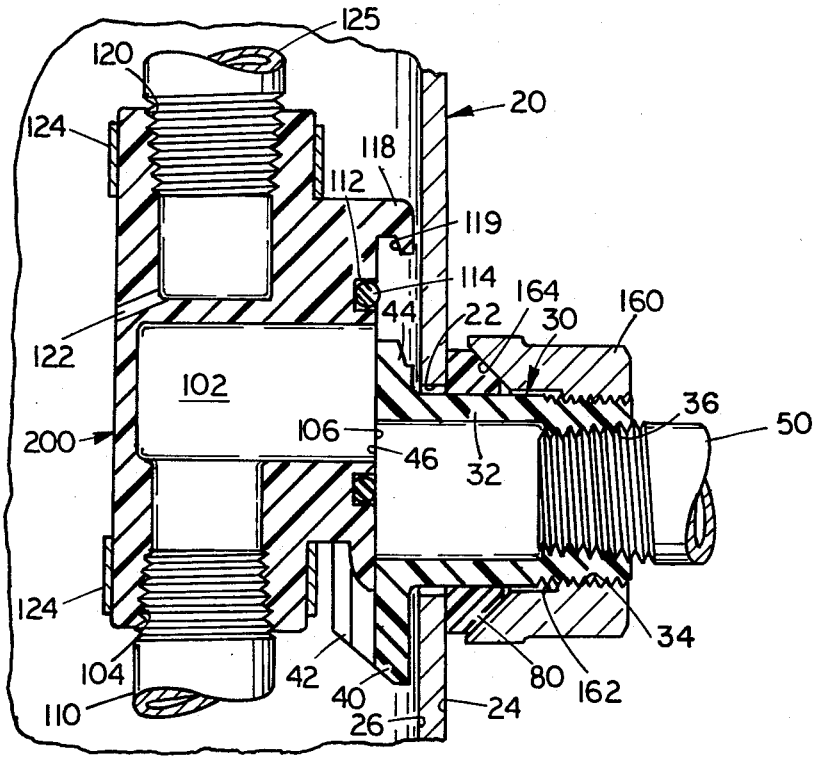
FIG. III
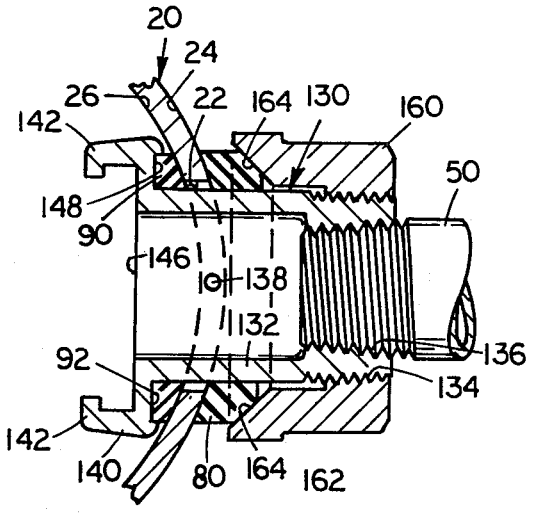
FIG. IV
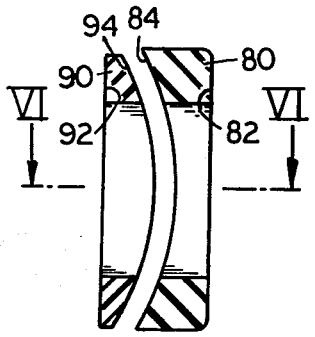
FIG. V
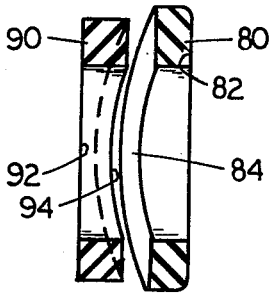
FIG. VI

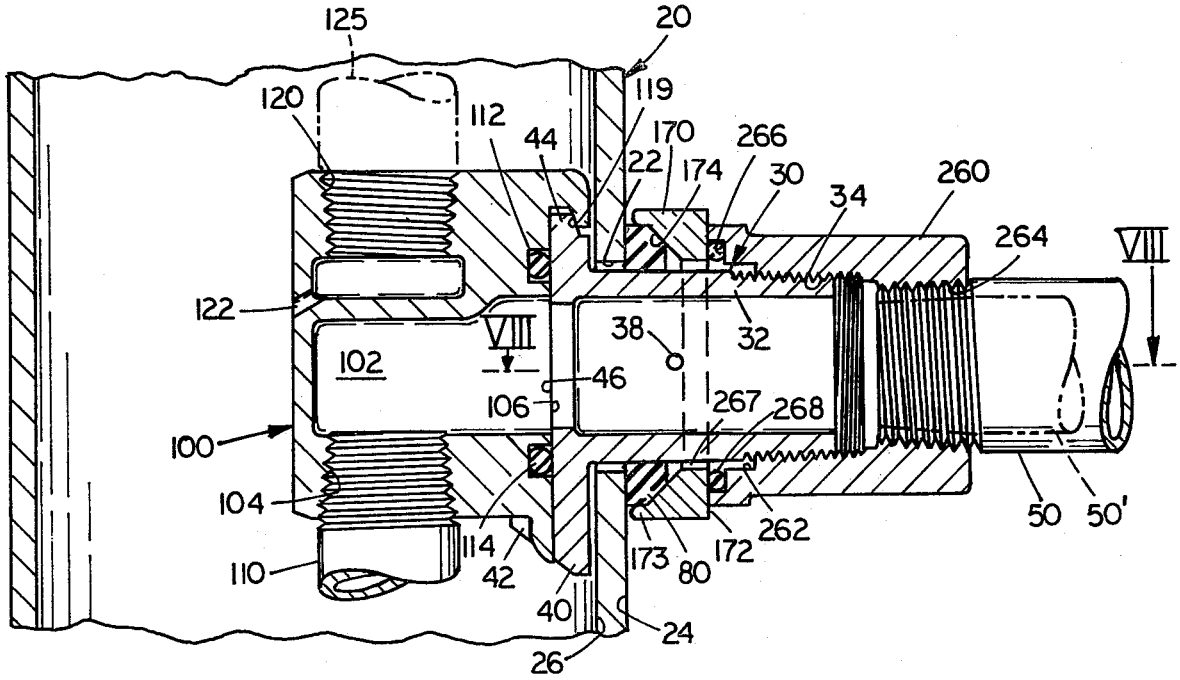
FIG. VII
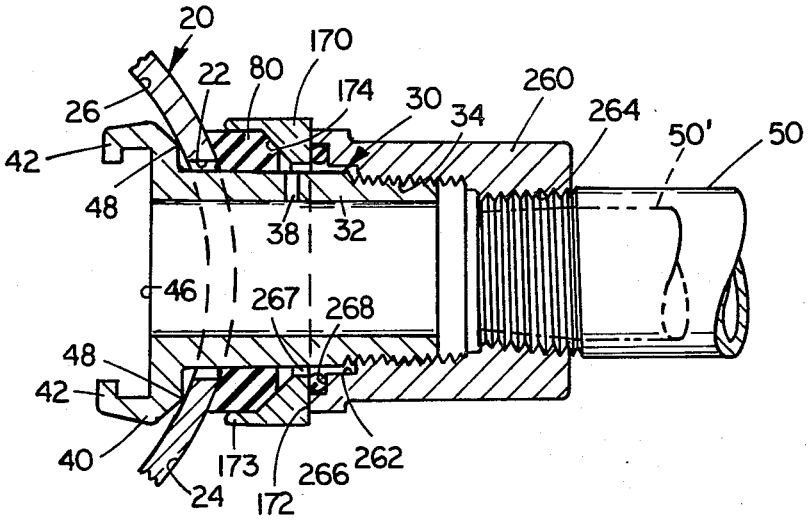
FIG. VIII

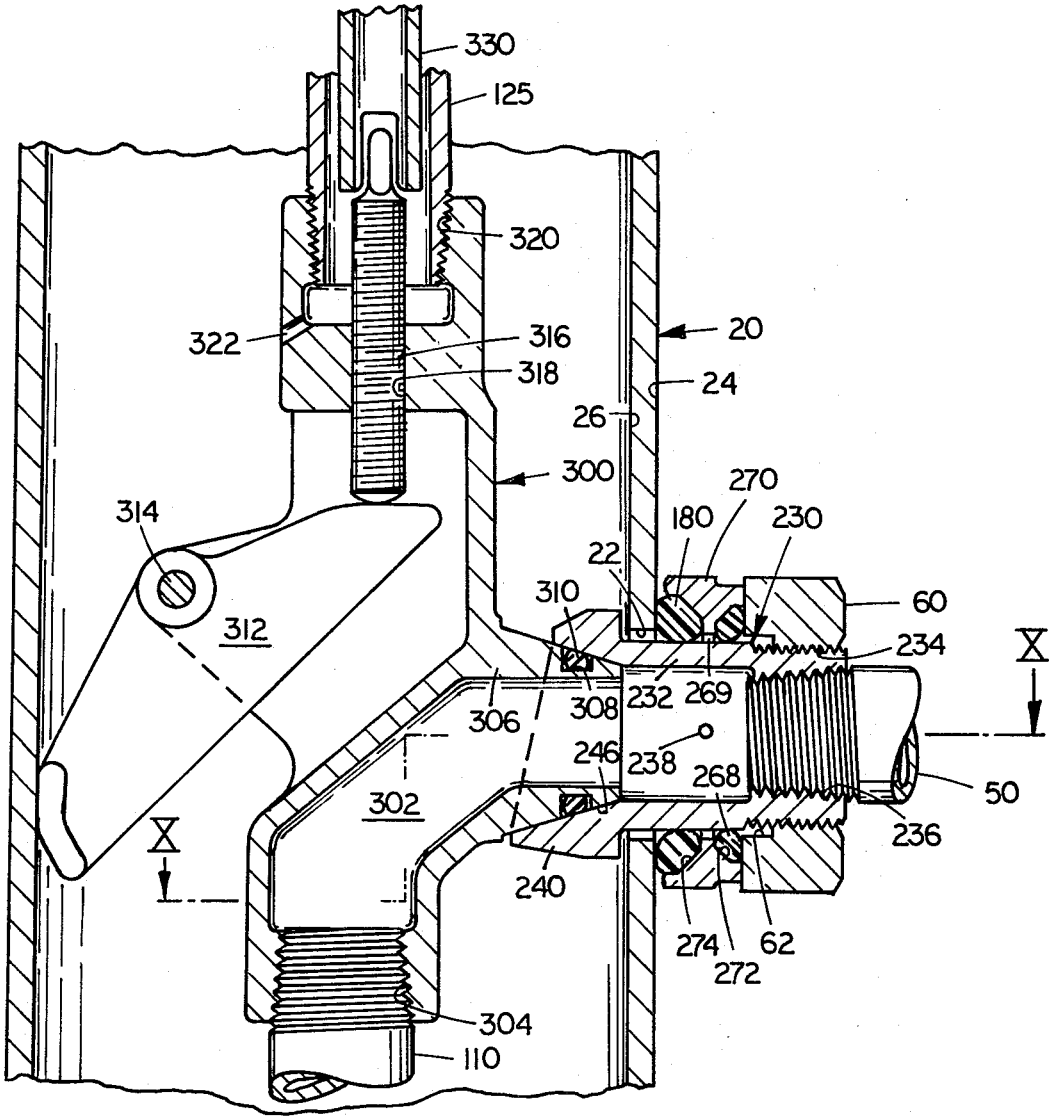
FIG. IX
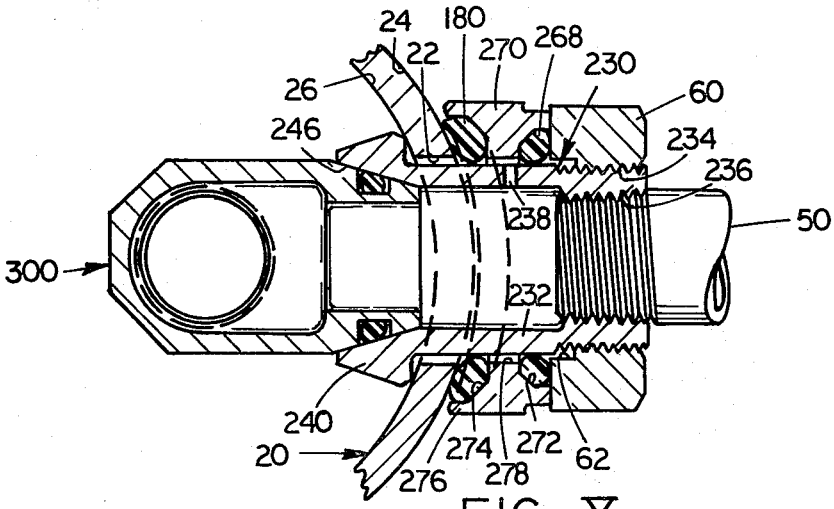
FIG. X

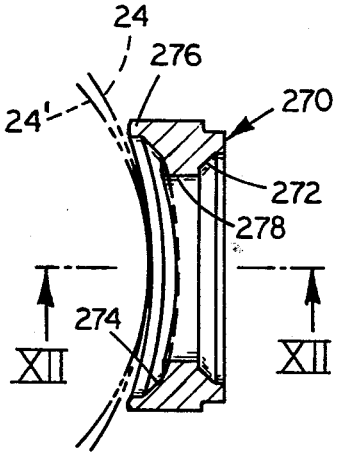
FIG. XI
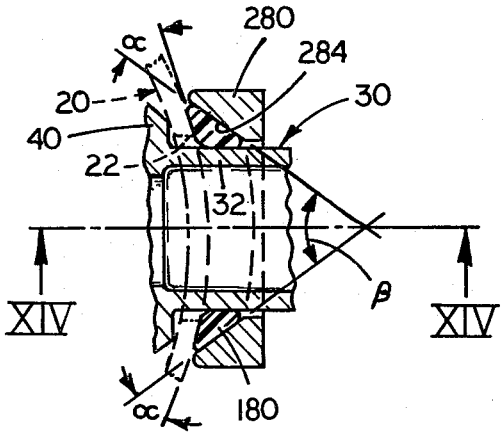
FIG. XIII
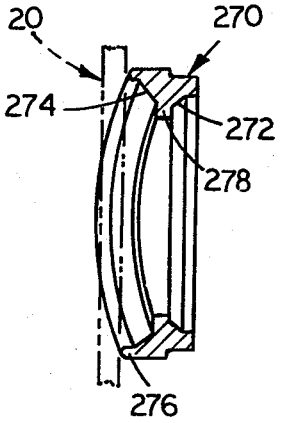
FIG. XII
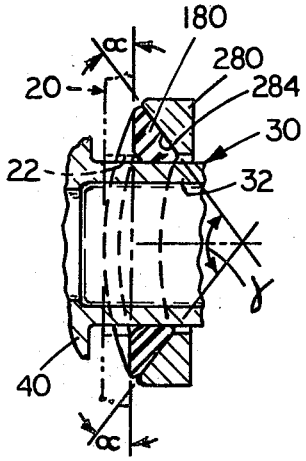
FIG. XIV

POSITIVE SEAL PITLESS WELL ADAPTER

RELATED APPLICATIONS

This is a continuation-in-part application of applicant's copending application Ser. No. 660,396 filed Feb. 23, 1976.

BACKGROUND OF THE INVENTION

It has been found that relative increases in pressure in the duct through the hanger member and its nipple in former side pipe well adapters can cause leakage around the nipple portion of the hanger member between the gasket and the outside wall of the nipple, which leakage will prevent this adapter passing some of the State codes requiring such gaskets to be pressurized.

Accordingly, it is a purpose of this invention to improve the adapter shown in this Wellstein U.S. Pat. No. 3,812,910, and to overcome the above mentioned inadequacy of it and other positive seal pitless well adapters.

SUMMARY OF THE INVENTION

Generally speaking the well casing side pipe adapter of this invention comprises a hanger member with a nipple portion which extends through a radial hole in the side of a vertical well casing, and an elbow duct member which connects with the hanger member. Suspending from this elbow duct member is a pipe which extends downwardly in the well casing and which pipe may support a pump at its lower end. The elbow duct may also comprise a drainable socket in its top for connecting a pipe or rod for positioning this elbow duct member with its depending pipe and pump in the well casing onto the hanger member. This positioning rod also may provide a means for operating a lever for urging this elbow member into sealable contact with the duct inside of the nipple of the hanger member. Either one or both of these adapter members may be made of plastic, and may have reinforcing rings around their respective threaded portions.

Referring first to the hanger member with the nipple portion, the hanger part thereof comprises a flanged plate portion on the duct inside the well casing larger than the hole in the well casing so that this member may be clamped to the well casing by a threaded nut member on the nipple portion outside of the well casing. The surface of this plate portion adjacent the inner wall of the well casing is horzontally convex and has two vertical parallel ridges for contacting the inside vertical wall of the well casing on each side of the opening therein. Beyond these two ridges and on the other side of the plate portion are two vertical outwardly and inwardly extending flanges forming a vertical track with a substantially C-shaped horizontal cross-section, the central flat surface of which surrounds the inner open end of the duct in the nipple portion. In one embodiment the plate surface of the portion adjacent the inside wall of the well casing is provided with an annular seat around the outside of the hole in the well casing for a gasket contoured to the inside wall of the well casing.

The nipple portion of this hanger member which extends through and radially outwardly from the hole or aperture in the well casing may be internally and/or externally threaded for connecting to a side pipe, and is externally threaded at its outer end for a clamping nut means which urges a gasket around the nipple portion adjacent the outside wall of the well casing surrounding the hole in the casing. The internally threaded portion of this nut means may be stepped radially inwardly from the inner cylindrical surface thereof so that the nut means can urge the gasket and/or a washer over the smooth unthreaded outer cylindrical portion of the nipple adjacent the well casing. This nut means also may extend axially outwardly beyond the nipple portion and be internally taper threaded to fit different size side pipes.

This gasket is made out of flexible and preferably resilient material, such as rubber or plastic, and is contoured to the saddle shaped joint it is to seal, i.e. the juncture between a smaller cylindrical pipe radially to a larger cylindrical pipe. This gasket is seated in an annular frusto-conical groove in the nut means or in an intermediate washer, which groove may be contoured to the outer wall of the well casing when a uniform radial cross-section gasket is used. An important feature of this invention is providing this groove with a bevelled or frusto-conical bottom which forms a conical angle coaxial with the axis of the nipple. The bevelled bottom preferably extends over a substantial portion of the base of the groove or seat for the gasket if not the whole seat, so that a perpendicular to any radial cross-section of this annular groove at about the center of the bevel will tend to bisect the angle between the outer vertical cylindrical surface of the well casing and the outer horizontal cylindrical or conical surface of the nipple. This bevelled or frusto-conical seat or bottom has the important advantage of pressing the gasket into tight sealing contact with both the well casing and the nipple when the gasket is moved only axially by the nut means. This frusto-conical seat for the gasket may be provided with axially and radially extending flange portions to provide space for the gasket to be deformed without being squeezed out of its seat. However, the outer peripheral axial or horizontal flange of this seat preferably is substantially contoured to the outer surface of the well casing, but not so much that it will contact the casing other than along the vertical diameter of this flange, thereby permitting the use of this adapter on various diameter well casings.

In addition to the nut means there may be provided a washer which has this bevelled bottom groove or frusto-conical seat therein and acts as an intermediate member between the nut means and the gasket against the well casing. This washer has at least one radially flat side, namely that side adjacent the nut means. Furthermore, the washer may have two such grooves, one at each end or side thereof with separate gaskets for each, one between the well casing and the washer and the other between the washer and the nut, so as to form a space between the two axially spaced gaskets on the nipple outside of the well casing, which space may be pressurized by the provision of a radial hole through the nipple between these gaskets.

Referring now to the elbow member inside the well casing, this member is provided with an elbow duct, the lower vertical outlet end of which is internally threaded for the connection of a down pipe, and the other horizontal outlet end of which is aligned with the inner open end of the duct in the nipple portion of the hanger member, either by a nose for insertion into this open end of the nipple member, or with a vertical flat surface with parallel edges which slides into the C-shaped cross-sectional track of the flange on the hanger member. Both horizontal outlets are provided with surrounding gaskets to seal with the hanger member. The flat slide portion is preferably provided with lower bevelled corners for easy insertion into the track, and its upper end is provided with a hook type stop which hooks over the back of the top edge of the plate portion of the hanger member, which hook may have its inner surface bevelled for urging this slide into intimate contact with the plate, as well as to relieve outward pressure on the inwardly extending flanges of this track.

The top of the elbow member may be provided with an internally threaded socket with a drain hole for the connection of a rod or pipe for locating and/or supporting the elbow member and its depending pipe and pump in the well casing from the top thereof. The elbow member and preferably the one having the nose horizontal outlet, also has a lever horizontally pivoted therein, which lever is urged by a threaded bolt to press against the inside of the well casing opposite the horizontal outlet to urge the nose outlet into sealing contact with the duct in the nipple hanger member. Thus the pipe for positioning the elbow member in this embodiment, also may have a central wrench means for turning the bolt to operate the lever to clamp the elbow member in position.

OBJECTS AND ADVANTAGES

Accordingly, it is an object of this invention to produce an efficient, effective, simple, economic, strong, and hermetically sealable side duct adapter for a well casing.

Another object is to produce a seal for hermetically sealing between two substantially perpendicular cylindrical surfaces of different diameters with one gasket, such as between the outside of a well casing and the outside of a nipple for a side pipe extending through an aperture in the well casing.

Still another object is to provide saddle contoured washers around a radial aperture or hole in a well casing for sealing both the inside and outside thereof to duct means communicating with each other through said aperture.

BRIEF DESCRIPTION OF THE VIEWS

The above mentioned and other features, objects and advantages, and a manner of attaining them are described more specifically below by reference to embodiments of this invention shown in the accompanying drawings, wherein:

FIG. I is a vertical section of an improved positive sealing means for pitless well adapter according to one embodiment of this invention, showing a hanger nipple member extending through an aperture in the side of a partially-shown well casing, its co-operating hooked elbow member being dropped in position, and a contoured gasket outside the well casing being forced into sealing engagement by a frusto-conical washer urged by a nut outside the nipple;

FIG. II is a horizontal section taken along line II—II of FIG. I showing the increased thickness of the gasket contoured to the saddle-shaped surface between the casing and the nipple;

FIG. III is a vertical sectional view similar to FIG. I showing another embodiment of this invention in which the elbow duct member and hanger member are made of plastic and the nut has the frusto-conical seat for urging the contoured gasket against the outside of the casing and nipple portion of the hanger member;

FIG. IV is a horizontal sectional view similar to FIG. II, but showing a contoured gasket inside the well casing, as well as outside the well casing, with a frusto-conical seat for the outer contoured gasket being on the nut portion as shown in FIG. III;

FIG. V is a vertical section of the two contoured gaskets in the position shown in FIG. IV before they are compressed;

FIG. VI is a sectional view taken along line VI—VI of FIG. V further illustrating the saddle contours of the casing engaging faces of the contoured gaskets of FIG. V;

FIG. VII is a vertical sectional view similar to FIG. I of still another embodiment of this invention showing the elbow duct member in position, and a gasket between the nut portion and the frusto-conical seated washer for the outer casing contoured gasket, and a taper tapped extension on the nut portion for the side pipe connection;

FIG. VIII is a horizontal section taken along line VIII—VIII of FIG. VII;

FIG. IX is a vertical sectional view similar to FIG. I of a further embodiment of the invention in which a nose is employed on the elbow member with a lever means for urging the nose into a conical opening in the duct of the nipple of the hanger member, and a washer having two frusto-conical seats for two gaskets providing a pressurized annular chamber communicating by a radial hole in the nipple portion outside the well casing;

FIG. X is a horizontal section taken along line X—X of FIG. IX showing the contoured circumferential flange on the washer member adjacent the well casing;

FIG. XI is a vertical sectional view of the washer shown in FIGS. IX and X showing the extent of the contoured flange for fitting different size well casings;

FIG. XII is a horizontal section taken along line XII—XII of the washer shown in FIG. XI;

FIG. XIII is a horizontal section similar to FIG. X showing an elliptically contoured conical seat in a washer for a uniformly radially cross-section gasket for sealing the saddle-shaped connection between the outer casing and nipple;

FIG. XIV is a horizontal section taken along line XIV—XIV of FIG. XIII showing the different angle of the elliptical contoured frusto-conical seat in the washer.

DETAILED DESCRIPTION OF PREFERRED EMBODIMENTS

In the figures, the well casing 20 has a radial aperture 22, an outer cylindrical surface 24, and an inner cylindrical surface 26.

1. The Hanger Members

Each of the different hanger members 30, 130 and 230 shown in the different embodiments in FIGS. I–III, IV and IX, respectively, has a sleeve or nipple portion 32, 132 and 232 with an exteriorly threaded outer end 34, 134 and 234 and at its inner end inside the casing 20 has an enlarged flange portion 40, 140 or 240, larger than the diameter of the hole 22 in the casing, so that the hanger member may be clamped by a nut means 60, 160 and 260 (described later) against the inner wall 26 of the casing 20.

In the embodiments shown in FIGS. I through VIII, the flange portion 40 is shown to comprise a horizontally C-shaped track having vertical inwardly extending parallel rails 42 and 142, which may either be tapered to be narrower at their lower ends, or may have an entirely uniform cross-section and/or have a stop means 44 at their upper end, and/or at their lower end (not shown). In between the tracks 42 or 142 there is provided a vertical flat surface 46 or 146 having a centrally located aperture communicating with the duct in the hanger member 30 or 130. On the opposite or back side of the flange portion 40 from that of the tracks and rails 42 and 142, there are preferably provided a pair of parallel ridges 48 for engaging the inner surface 26 of the well casing 20 for vertically aligning the tracks parallel to the axis of the casing 20 (see FIGS. II and VIII).

The flange means 240 shown in the embodiments of FIGS. IX and X comprises a frusto-conical central opening 246 axially aligned with the duct in the center of the nipple portion 232 of the hanger member 230.

If desired, the outer end of the nipple portion 32 or 232 may be internally taper threaded at 36 or 236 for the connection of a horizontal side pipe 50. However, this side pipe 50 may be connected into an outward extension on the nut means 260 instead, as shown in FIGS. VII and VIII and described later.

The nipple portion 32, 132 or 232 also may be provided with a radial hole 38, 138 or 238 respectively, for pressurizing the gasket around the outside of the well casing 20.

The only distinction between the hanger member 30 shown in FIGS. I and II and that in FIG. III is that this member in FIG. III is shown to be made of a plastic material instead of a metal such as brass.

The primary distinction of the hanger member 130 shown in FIG. IV is that between the flange member 140 and the inside surface 26 of the well casing 20, there is provided a flat annular seat 148 for an interior contoured gasket 90 as will be described later.

2. The Nut Means, Washers and Gaskets

Around the outer threaded portions 34, 134 and 234 of the hanger members 30, 130 and 230, there are provided nut means 60, 160 or 260 as shown in FIGS. I, III and VII, respectively, which nut means provide the clamping action for clamping the flange means 40, 140 or 240 tightly against the inside wall 26 of the well casing 20. In the embodiments shown in FIGS. I, II, IX and X, the nut means 60 comprises a simple annular nut with flat ends and threaded internally.

The inner end of these nut means may be provided with a countersunk or stepped portion 62 or 162 so that this inner end of the nut means may be threaded beyond the end of the threads 34 for further urging a washer and/or gasket against the outside of the well casing 20. However, only a gasket and not both a washer and gasket may be employed; in which case the seat 164 for the gasket may be incorporated in the inner end of the nut means 160 as shown in FIGS. III and IV.

A preferred embodiment of this seat 164 for the gasket 80 has a frusto-conical surface. However, in the embodiments shown in FIGS. I and VII there are provided separate washer members 70 and 170 with frusto-conical seats 74 and 174 on their inner ends or sides for their gaskets 80, and flat annular outer ends or sides 72 and 172 for engaging the inner ends of the nut means 60 and 260. The gasket 80 correspondingly has an outer flat annular surface 82 for engagement with these frusto-conical seats 74, 164 and 174 and an inner saddle-shaped contoured surface 84 (see FIGS. V and VI) for approximating the contour of the junction around the hole 22 of the intersection between the larger cylindrical surface 24 of the well casing 20 and the smaller cylindrical surface of the nipple portion 32, 132 and 232 of the hanger members 30, 130 and 230. It is an important feature of this invention that these seats for the contoured gasket 80 have frusto-conical surfaces so as to compress the contoured gasket 80 both against the outer wall 24 of the well casing 20 as well as against the outer cylindrical wall of the nipple portions 32, 132 and 232. Thus, any radial bisection of the saddle angle between the outer surface 24 of the well casing 20, and the outer cylindrical surface of the nipple portion 32, 132 and 232 should be substantially perpendicular to these frusto-conical seats 74, 164 and 174 so that any axial compression of the gasket 80 by these frusto-conical seats will compress the contoured gasket 80 both against the outside surface 26 of the well casing 20 and the nipple portions 32 and 132 around the aperture 22, thereby completely sealing the aperture 20 from anything outside the well casing 20 and side duct 50, and also enabling this gasket 80 to be pressurized.

As shown in FIG. IV, a second contoured gasket 90 may also be provided around the nipple portion 132 inside the well casing 20. This gasket 90 is seated in the flat annular seat 148 provided on the back side of the flange portion 140. The seat engaging side 92 of this gasket 90 is flat and annular, while its well casing engaging surface 94 is contoured to substantially conform with the inner surface 26 of the well casing 20 surrounding the hole 22. The saddle contours of the well casing engaging surfaces of the gaskets 80 and 90 are more clearly shown in FIGS. V and VI, being respectively concave and convex for sealing the saddle-shaped joint formed between the larger cylindrical surfaces of the casing 20 and the intersecting smaller cylindrical surfaces of the nipple portions. Thus, the gasket 90 in combination with the gasket 80 provide an annular chamber 92 between the inside of the hole 22 and the outside of the nipple portion 132, which chamber may be pressurized through a radial aperture 138 through the wall of the nipple portion 132. This is pressurized by the pressure of the fluid through the nipple portion 132.

If desired, the washer 70 may be provided with an axially extending flange 173 as shown for the washer 170 in FIGS. VII and VIII. This flange may be contoured slightly so as to be slightly saddle-shaped to retain the contoured gasket 80, particularly at the receding sides of the casing 20 as shown in FIG. VIII.

Referring further to this embodiment shown in FIGS. VII and VIII, the nut means 260 is extended outwardly beyond the threaded portion 34 of the nipple portion 32 and is internally taper threaded at 264 so as to fit the diameter of a different size sided pipe 50 or 50'. Thus, different size nut means 260 may be used for adapting a standard hanger member 30 to fit different diameter side pipes. The nut means 260 as shown in FIGS. VII and VIII may also be provided with a second gasket seat 266 into which an O-ring gasket 268 may be seated for sealing the inner end of the nut means 260 against the washer 170. Thus an annular pressurizable chamber 267 is provided, which may be pressurized by a radial hole 38 through the nipple portion 32 of the hanger portion 30, in that this chamber 267 is now sealed at its one end by the gasket 80, in the middle by the O-ring 268, and at its other end by the conical threads 264 of the side pipe 50.

A still further embodiment of a washer 270 is shown in FIGS. IX through XII which has a second seat 272 for a second gasket or O-ring 268 between the nut means 60 and the washer 270. Since the gasket 268 has a frusto-conical seat 272, it also seals the gasket 280 not only against the face of the nut 60, but also against the outer cylindrical surface of the nipple portion 232, so that between it and the gasket 180 there is also provided an annular chamber 269 which can be pressurized from the duct in the center of the nipple portion 232 via the radial hole 238.

The other seat 274 for the gasket 180 in this washer 270 may be elliptically frusto-conical as better shown in FIGS. X, XI, and XII. In this case, the sealing gasket 180 may have a uniform radial cross-section such as an O-ring, in that the beveled bottom portion of the seat 274 has a saddle-shaped contour which follows substantially the saddle contour of the joint between the large cylindrical outside surface 24 of the casing 20 and the intersecting outside smaller cylindrical surface of the nipple portion 232. This particular washer 270 is also shown to have both axially and radially extending flange portions 276 and 278, respectively, which axially extending flanges 276 do not extend axially as far as the actual contour of the largest size surface 24 of the casing 20 as shown in FIG. XI so as to permit the use of this washer 270 for different size casings 24 and 24' shown in dot-dash lines. In this instance, the only contact that could occur between the flange portion 276 and the casing 20 would be along the vertical axis of the junction as shown in FIG. XII.

Still further, the washer 280 may not have a flanged seat for the O-ring gasket 180, but may have only an elliptical frusto-conical seat 284 as shown in FIGS. XIII and XIV. Such an elliptical frusto-conical seat is more clearly shown in FIGS. XIII and XIV wherein the minor and major axes of the elliptical cone subtend apex angles $\beta$ and $\gamma$ respectively, and vary in between so that the angle $\alpha$ between the seat 284 and the outer surface 24 of the casing 20 will be substantially the same all around the hole 22. Thus, any radial bisector of the angle between the outer surface 24 of the casing and the outer surface of the nipple 32 will be more substantially perpendicular to the beveled or elliptical frusto-conical surface of the seat 284 so as to insure substantial equal pressure at all angles of the O-ring gasket 180, completely sealing the saddle-shaped joint around the hole 22.

3. The Elbow Members

In FIGS. I, III and IX there are shown different embodiments of elbow members 100, 200 and 300, respectively.

The embodiments shown in FIGS. I, III and VII of elbow members 100 and 200 comprise L-shaped ducts 102, the lower ends of which have internal tapered threads 104 for attachment of a drop pipe 110. The other ends of the ducts 102 terminate in openings in flat slide surfaces 106 which align with the openings in the flat surface 46 of the tracks in the flanges 44 of the hanger members 30 and 130. Around one of these openings may be provided annular grooves 112 for seating O-ring gaskets 114 which are compressed when the members 100 and 200 are slid in the direction shown by the arrow 116 in FIG. I into the position shown in FIG. VII to seal the connection between the surfaces 106 and 46 around these aligned openings. The surfaces 106 have parallel side edges which are preferably beveled at their lower ends for easy insertion between the rails 42 and 142. These parallel sides may be tapered or wedge-shaped and/or provided with a stop engaging means at their top and/or bottom, such as hook portions 118 for engaging the stop portions 44. If desired, these hook portions 118 may be provided with a beveled end 119 as shown in FIGS. I, III and VII, which co-operates with a similar beveled surface on the back of the stops 44 for further urging the elbow members 100 into intimate contact with their hanger member 30 and 130 for further compressing the O-rings 114.

There also are provided in the elbow members 100 and 200 threaded sockets 120, which preferably have drain apertures 122, into which sockets 120 there are screwed pipe sections or installation rods 125 for lowering the elbow members 100 and 200 into position down the well casings 20 for attachment with the hanger portions 30 and 130.

The major distinction between the elbow members 100 and 200 shown in FIG. III, is that the latter is made out of plastic, and since there is no outside metallic nut means 160 or sleeve for reinforcing their internally threaded sockets as for the plastic nipple portion shown in FIG. III, there are shown metallic rings 124 surrounding and/or embedded in the plastic member 200 around the internally conically threaded portions 104 and sockets 120.

Referring now to the elbow member 300 shown in FIGS. IX and X, it has an L-shaped duct 302, the lower end 304 of which is internally taper threaded for receipt of the down pipe 110. However, the other end of the duct 102 is provided with a frusto-conical nose portion 306 for fitting into the frusto-conical opening or seat 246 in the hanger member 230. This frusto-conical nose 306 may be provided with an annular groove seat 308 for an O-ring type gasket 310 to seal the nose 306 in the opening 246. In order to insure the sealing between this nose 306 and the opening 246, there is provided a lever member 312 which has a central pivot 314. Thus lever 312 is actuated by a threaded bolt means 316 which acts on the one end of the lever 312 to push its other end against the inside wall 26 of the well casing 20 opposite the hole 22 to force and maintain the nose portion 306 into sealing engagement in the frusto-conical opening 246. This bolt means 316 is threaded in an aperture 318 in the bottom of the conical threaded socket 320 having a drain outlet 322. This socket 320 is for the elbow member 300 positioning pipe 125 through the center of which pipe 125 there may be inserted a wrench means 330 for rotating the bolt 316.

It should be clearly understood that although a nut means and washer and contoured gasket are employed in the embodiment in FIG. I, the nut means 60 and washer 70 may be replaced by a nut 160 with a frusto-conical seat for the gasket 80, and vice versa, for the embodiment shown in FIGS. III and VII. Similarly, instead of using this frusto-conical seat as shown in FIG. I, the seats may have radial and axial flanges as shown in the embodiments of the washer 270 and/or if a gasket 180 of uniform radial cross-section is to be used instead of contoured gaskets 80 and 180, the washers and/or the nut means may have gasket seats which are elliptical frusto-conical or contoured to the saddle joint around the casing hole 22 as shown, for example, in the embodiments of FIGS. IX through XIV.

Furthermore, it is to be understood that the different types of connections for the elbow members with the hanger member may be interchanged with the different types of sockets and with different type of means for holding the elbow members against the hanger members than those shown herein and as known in the prior art.

Thus, while there is described above the principles of this invention in connection with specific apparati, it is to be clearly understood that this description is made only by way of example and not as a limitation to the scope of this invention.

I claim:

1. In an adapter for a side duct to a main duct having an outer cylindrical convex surface and having a radial hole through said surface, said adapter comprising:

A. a nipple having an outer cylindrical surface and having its axis extending radially outwardly from its inner end held in said hole, said side duct being connected to the outer end of said nipple, B. sleeve means around said nipple comprising a nut means threaded on said nipple at the outer end of said nipple, C. a gasket between said sleeve means and said main duct for engagement with both the outside cylindrical surfaces of said main duct and of said nipple, the improvement comprising:

D. a frusto-conical seat on said sleeve means for said gasket, and

F. a saddle-shaped surface on one of said gasket and said seat contoured to substantially conform with the junction intersection between said main duct and said side duct, whereby axial thrust by said nut means against said gasket in said seat compressingly seals said gasket both against the outer cylindrical convex surface of said main duct and the outer cylindrical surface of said nipple.

2. An adapter according to claim 1 wherein said gasket has its surface toward said main duct contoured concave cylindrically to conform with the cylindrical surface of said main duct around said hole.

3. An adapter according to claim 1 wherein said gasket has its surface toward said seat substantially flat and perpendicular to the axis of said nipple.

4. An adapter according to claim 1 wherein said seat is saddle-shaped to substantially conform with said junction intersection between the cylindrical surface of said main duct and the cylindrical surface of said nipple.

5. An adapter according to claim 4 wherein said gasket has a substantially uniform radial cross-section.

6. An adapter according to claim 1 wherein said seat includes an axial flange extending outwardly cylindrical from the periphery thereof.

7. An adapter according to claim 6 wherein said axial flange has its edge adjacent said main duct contoured slightly to conform to the adjacent cylindrical surface of said main duct.

8. An adapter according to claim 1 wherein said seat includes a radial flange extending inwardly from the frusto-conical seat.

9. An adapter according to claim 1 wherein said seat includes both axial and radial flanges extending away from the frusto-conical portion of said seat.

10. An adapter according to claim 1 wherein said sleeve means includes a washer between said nut means and said main duct around said nipple, and said seat is located in said washer toward said main duct.

11. An adapter according to claim 10 wherein said washer has a flat surface perpendicular to the axis of said nipple adjacent said nut means.

12. An adapter according to claim 10 wherein said washer and its nut means have two seats, one on each side of said washer, each of which seats are frusto-conical and wherein separate gaskets are located in each of said seats.

13. An adapter according to claim 12 wherein at least one of said gaskets has a uniform radial cross-section.

14. An adapter according to claim 12 wherein an annular chamber is formed around said nipple between said two gaskets.

15. An adapter according to claim 14 wherein said nipple includes a radial hole connecting the inside of said nipple with said chamber.

16. An adapter according to claim 1 wherein said main duct is a vertical well casing and said duct is a horizontal side pipe extending away from said well casing.

17. An adapter according to claim 1 wherein said nipple includes a flange portion inside said main duct larger in circumference than the diameter of said hole in said main duct.

18. An adapter according to claim 17 wherein said flange portion includes a side track of substantially C-shaped cross-section.

19. An adapter according to claim 18 including an elbow member having an elbow duct therein and a flat plate slidable in said track.

20. An adapter according to claim 18 wherein said flange portion on said nipple comprises a pair of ridges parallel to said track and spaced inwardly thereof for engagement with the inner cylindrical surface of said main duct on each side of said hole in said main duct.

21. An adapter according to claim 20 wherein said flange portion is convex toward the inner surface of said main duct between said parallel ridges.

22. An adapter according to claim 17 wherein the flange portion around said nipple includes an annular groove and a contoured gasket in said groove having a convex surface contoured to the inner concave cylindrical surface of said main duct around said hole to form an annular chamber between said washers.

23. An adapter according to claim 22 including a radial hole through said nipple between said gaskets for pressurizing said chamber.

24. An adapter according to claim 19 including a stop means for limiting the sliding movement of said plate in said track.

25. An adapter according to claim 24 wherein said stop means comprises a hook means on said elbow member for engaging the top of said flange portion on said nipple.

26. An adapter according to claim 25 wherein said hook means has a beveled surface for engagement with the back of said flange portion on said nipple for urging said elbow member against said flange portion.

27. An adapter according to claim 1 including an elbow member having an elbow duct with a nose portion for fitting into said nipple from inside main duct.

28. An adapter according to claim 27 wherein said elbow member includes a lever means operated by thread means for pushing said lever means against the inside of said main duct opposite said hole for urging said nose into sealing contact with said nipple.

29. An adapter according to claim 1 wherein said gasket is composed of a resilient material.

30. An adapter according to claim 1 wherein said nipple is internally threaded for connection of said side duct.

31. An adapter according to claim 1 wherein said nut means is internally threaded for connection of said side duct.

32. A side pipe well casing adapter comprising:

A. a well casing having a cylindrical outer surface a radial hole in its side,

B. a hanger member having a nipple portion having an outer cylindrical surface extending through said hole and having a flange means around said hole in said casing, C. a first pipe coupled and extending outwardly from said nipple portion, D. an elbow member inside said casing sealingly connected to said flange means, E. a second pipe in said casing connected to the other end of said elbow member, F. a sleeve means around said nipple portion and comprising a nut means threaded onto the outer end of said nipple portion, and G. A gasket between said sleeve means and said outer surface of said well casing, the improvement comprising:

H. a frusto-conical seat means on said sleeve means for said gasket, and

I. a saddle contoured surface on one of said gasket and said seat to substantially conform with the junction between said well casing and said nipple portion, whereby axial thrust by said nut means against said gasket compressingly seals said gasket both against the outer cylindrical surface of said casing and the outer cylindrical surface of said nipple portion.

33. An adapter according to claim 32 wherein said gasket has its surface toward said well casing contoured concave cylindrically to conform with the cylindrical surface of said well casing around said hole.

34. An adapter according to claim 32 wherein said gasket has its surface toward said seat substantially flat and perpendicular to the axis of said nipple.

35. An adapter according to claim 32 wherein said seat is saddle-shaped to substantially conform with said junction between the cylindrical surface of said well casing and the cylindrical surface of said nipple portion.

36. An adapter according to claim 35 wherein said gasket has a substantially uniform radial cross-section.

37. An adapter according to claim 32 wherein said seat includes an axial flange extending outwardly cylindrical from the periphery thereof.

38. An adapter according to claim 37 wherein said axial flange has its edge adjacent said well casing contoured slightly to conform to the adjacent cylindrical surface of said well casing.

39. An adapter according to claim 32 wherein said seat includes a radial flange extending inwardly from the frusto-conical seat.

40. An adapter according to claim 32 wherein said seat includes both axial and radial flanges extending away from the frusto-conical portion of said seat.

41. An adapter according to claim 32 wherein said sleeve means includes a washer between said nut means and said well casing around said nipple portion, and said seat is located in said washer toward said well casing.

42. An adapter according to claim 41 wherein said washer has a flat surface perpendicular to the axis of said nipple adjacent said nut means.

43. An adapter according to claim 41 wherein said washer and said nut means have two seats, one on each side of said washers each of which seats are frusto-conical and wherein separate gaskets are located in each of said seats.

44. An adapter according to claim 43 wherein at least one of said gaskets has a uniform radial cross-section.

45. An adapter according to claim 43 wherein an annular chamber is formed around said nipple between said two gaskets.

46. An adapter according to claim 45 wherein said nipple includes a radial hole connecting the inside of said nipple with said chamber.

47. An adapter according to claim 32 wherein said flange means includes a slide track of substantially C-shaped cross-section.

48. An adapter according to claim 47 wherein said elbow member includes a flat plate slidable in said track.

49. An adapter according to claim 47 wherein said flange means on said nipple portion comprises a pair of ridges parallel to said track and spaced inwardly thereof for engagement with the inner cylindrical surface of said well casing on each side of said hole in said well casing.

50. An adapter according to claim 49 wherein said flange means is convex toward the inner surface of said well casing between said parallel ridges.

51. An adapter according to claim 32 wherein the flange means around said nipple portion includes an annular groove and a contoured washer in said groove having a convex surface contoured to the inner concave cylindrical surface of said well casing around said hole to form an annular chamber between said washers.

52. An adapter according to claim 51 including a radial hole through said nipple portion between said gaskets for pressurizing said chamber.

53. An adapter acording to claim 48 including a stop means for limiting the movement of said plate in said track.

54. An adapter according to claim 53 wherein said stop means comprises a hook means on said elbow member for engaging the top of said flange means on said nipple portion.

55. An adapter according to claim 54 wherein said hook means has a beveled surface for engagement with the back of said flange means on said nipple portion for urging said elbow member against said flange means.

56. An adapter according to claim 32 wherein said elbow member includes a nose portion for fitting into said nipple portion.

57. An adapter according to claim 56 wherein said elbow member includes a lever means operated by thread means for pushing said lever means against the inside of said well casing opposite said hole for urging said nose into sealing contact with said nipple portion.

58. An adapter according to claim 32 wherein said gasket is composed of a resilient material.

59. An adapter according to claim 32 wherein said nipple portion is internally threaded for connection of said first pipe.

60. An adapter according to claim 32 wherein said nut means is internally threaded for connection of said first pipe.

61. An adapter according to claim 32 wherein said elbow member is made of plastic.

62. An adapter according to claim 32 wherein said nipple member is made of plastic.

63. An adapter according to claim 32 wherein said nipple member and said elbow member each have at least one threaded portion around their ducts and at least one of said members are made of plastic having a ring around said threaded portion of said plastic.

64. An adapter according to claim 32 wherein said elbow member is provided with a drainable socket for attachment of an installation rod.

* * * * *